US009138085B2

(12) United States Patent
Kelkel et al.

(10) Patent No.: US 9,138,085 B2
(45) Date of Patent: Sep. 22, 2015

(54) SLEEPING BAG ABLE TO RECEIVE A MATTRESS, AND SLEEPING KIT INCLUDING A SLEEPING BAG AND A MATTRESS

(75) Inventors: Yohann Kelkel, Lille (FR); Adrien Gue, Passy (FR); Benjamin Lafoux, Saint Gervais les Bains (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 13/610,389

(22) Filed: Sep. 11, 2012

(65) Prior Publication Data

US 2013/0239325 A1 Sep. 19, 2013

(30) Foreign Application Priority Data

Sep. 12, 2011 (FR) ..... 11 58068

(51) Int. Cl.
*A47G 9/08* (2006.01)

(52) U.S. Cl.
CPC . *A47G 9/086* (2013.01); *A47G 9/08* (2013.01)

(58) Field of Classification Search
CPC ..... A47G 9/00; A47G 9/02; A47G 9/0238; A47G 9/0246; A47G 9/08; A47G 9/083; A47G 9/086
USPC ..... 5/413 R, 413 AM, 494, 496
See application file for complete search history.

(56) References Cited

U.S. PATENT DOCUMENTS

| | | | | |
|---|---|---|---|---|
| 4,989,282 | A * | 2/1991 | Goldstein | 5/413 R |
| 5,046,207 | A * | 9/1991 | Chamberlain | 5/496 |
| 5,560,056 | A * | 10/1996 | Tai | 5/120 |
| 5,640,725 | A * | 6/1997 | Ando et al. | 5/413 AM |
| 6,067,677 | A * | 5/2000 | Reen et al. | 5/499 |
| 6,675,414 | B2 * | 1/2004 | Lamke | 5/413 AM |
| 7,237,283 | B2 * | 7/2007 | Devries | 5/419 |
| 2004/0045086 | A1 * | 3/2004 | Zheng | 5/413 AM |
| 2008/0178386 | A1 * | 7/2008 | Thompson | 5/485 |
| 2010/0107332 | A1 | 5/2010 | Brune | |

FOREIGN PATENT DOCUMENTS

| | | | |
|---|---|---|---|
| FR | 2201059 | A1 | 4/1974 |
| FR | 2922739 | A1 | 5/2009 |
| KR | 100396056 | B1 | 8/2003 |
| WO | 0228239 | A1 | 4/2002 |
| WO | WO 2008031975 | A2 * | 3/2008 |

OTHER PUBLICATIONS

French Patent Office, Search Report in French patent application No. 1158068, dated Apr. 12, 2012.

* cited by examiner

*Primary Examiner* — Nicholas Polito
(74) *Attorney, Agent, or Firm* — Kenyon & Kenyon LLP

(57) ABSTRACT

A sleeping bag is able to be used in a first configuration with a mattress and in a second configuration without mattress, said sleeping bag comprising on the one hand a flexible panel or flexible panels that are put together, said flexible panel(s) being able to constitute a sleeping space for a user, and on the other hand a reception pocket able to receive said mattress in said first configuration, said reception pocket being interdependent with said flexible panel or with one of said flexible panels that are put together, towards its external face opposed to said sleeping space, said reception pocket presenting an introduction opening for said mattress and being provided with securing means able to secure said mattress in said reception pocket in said first configuration.

12 Claims, 2 Drawing Sheets

SLEEPING BAG ABLE TO RECEIVE A MATTRESS, AND SLEEPING KIT INCLUDING A SLEEPING BAG AND A MATTRESS

CROSS REFERENCE TO RELATED APPLICATION

The present application claims priority to French patent application No. 11-58068, filed Sep. 12, 2011, the content of which is incorporated herein by reference in its entirety.

FIELD OF THE INVENTION

The present invention concerns a sleeping bag. More precisely, the present invention belongs to the field of sleeping bags integrating a mattress. It applies to the field of the outdoor recreations, such as camping, for instance.

BACKGROUND

Usual sleeping bags are of course known, formed by a sole flexible textile panel that is turned down on itself so as to constitute a sleeping space, closed for instance by a zip fastener. Alternately, such sleeping bags can be formed by several flexible panels that are put together, for instance by sewing, so as to constitute said sleeping space.

When such a sleeping bag is used to sleep directly on the ground, when bivouacking for instance, the user would rather use a mattress, for obvious comfort reasons.

The user should thus carry a small mattress, or a groundsheet, that he could arrange on the ground, and on which he could lay his sleeping bag.

One of the issues that is then raised is that the sleeping bag and the mattress are not necessarily adapted to each other, and that, when the user is asleep, the sleeping bag tends to slide outside the mattress or the groundsheet.

Alternate solutions are known, that consist in a sleeping bag comprising a reception pocket in which a mattress can be inserted. This is, for instance, the case of the solution described in FR 2 922 739.

It is possible to use such a sleeping bag in a first configuration with the mattress, and in a second configuration without the mattress. The sleeping bag comprises a reception pocket able to receive the mattress in the first configuration. The reception pocket shows an introduction opening for the mattress and is provided with securing means that enable the mattress to stay in the reception pocket in the first configuration.

One of the issues raised by such a sleeping bag is that, when the user wants to use his sleeping bag without the mattress, for instance when he sleeps in a refuge in which there is already a mattress, the empty reception pocket forms a disturbing extra material. This extra material is necessary for supporting the mattress in the first configuration, but is not adapted in the second configuration.

As a matter of fact, the extra material involves a bigger sleeping bag, which as a matter of fact involves in turn heat losses due to the air blades that have formed in the part of the sleeping space that is not filled by the user's body.

Moreover, this extra material under the sleeping bag involves a discomfort mainly located in the back area of the user.

Also, many other solutions combining a sleeping bag and a mattress jeopardize the ease of the user to move in the sleeping bag. Indeed, the addition of the mattress often involves a material tension or a blocking of the sleeping bag in a given position, and thus a decrease in the freedom of movement. This is in particular the case for the solution described in WO 0228239.

It is therefore an objective of the present invention to solve these issues among others.

SUMMARY

Thus, the present invention consists in presenting a sleeping bag that can be used in a first configuration, with a mattress, and in a second configuration, without a mattress, with great comfort in both configurations.

The invention relates, in a first aspect, to a sleeping bag that can be used in a first configuration with a mattress and in a second configuration without a mattress.

The sleeping bag comprises a flexible panel or several flexible panels that are put together, this (these) flexible panel(s) making it possible to create a sleeping space for a user.

The sleeping bag also comprises a reception pocket appropriate for receiving a mattress in the first configuration. This reception pocket is interdependent with the flexible panel or with one of the flexible panels that are put together, towards its external face opposed to the sleeping space.

The reception pocket presents an introduction opening for the mattress and is provided with securing that enable the mattress to stay in the reception pocket in the first configuration.

This reception pocket is provided with first attachment means distributed around the introduction opening.

Moreover, the external face of the flexible panel is provided with second attachment means.

First and the second attachment means can cooperate together in the second configuration so that the introduction opening can be closed.

In a first variant embodiment, the securing means are arranged so that they can be stored in the reception pocket in the second configuration.

In a second variant, possibly in combination with the previous one, the securing means include at least a flexible rangy element, preferably elastic, inserted in a guide, such as a sheath, continuous or intermittent and disposed around the introduction opening, the flexible rangy element being able to slide in the guide.

Preferably, the guide presents at least an opening through which the flexible rangy element can be reached.

This guide can offer at least two openings, preferably diametrically opposed, through which the flexible rangy element can be reached.

Preferably also, the securing means include a blocking element that can limit the sliding of the flexible rangy element in the guide.

In case the guide offers at least two openings, the blocking can enable to bring together a portion of the flexible rangy element reached by one of the two openings formed in the guide with a portion of this flexible rangy element reached by the other of the two openings formed in said guide.

Alternately to the second variant, in a third variant embodiment possibly in combination with the first one, the securing means include at least an element made of plastic disposed continuously or intermittently around the introduction opening.

In a fourth variant embodiment, possibly in combination with one or several of the previous ones, the reception pocket is formed by one or several flexible panels with extra material, preferably elastic material, furnished for instance with cotton wool and/or feathers.

In this fourth variant embodiment, the sleeping bag is configured in such a way that, in the second configuration, the extra material can be stored inside the reception pocket in a closed position.

In another variant, possibly in combination with one or several of the previous ones, the external face of the flexible panel or one of the flexible panels constituting the sleeping space is made of elastic material.

The invention also relates, in a second aspect, to a sleeping kit including a sleeping bag as described above, and a mattress that can be disposed in the reception pocket.

BRIEF DESCRIPTION OF THE DRAWINGS

Other characteristics and advantages of the present invention will be understood more clearly and in a more complete manner on reading the description that follows of the preferred variant embodiments, which are given as non-limiting examples and illustrated in the following appended drawings.

DETAILED DESCRIPTION

Figure 1:
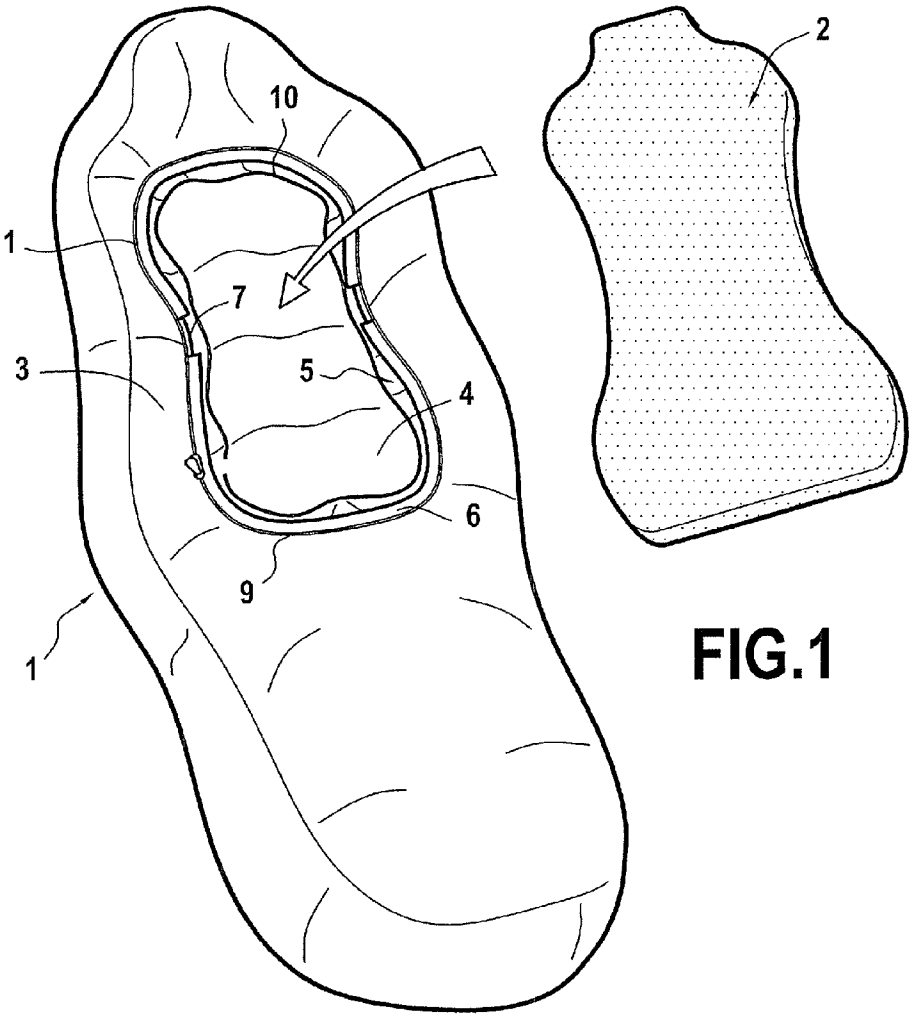
FIG. 1 is a view of an example of the sleeping bag of the present invention, in preparation of the first configuration with the mattress.

An example of a sleeping bag 1 of the present invention is represented in FIG. 1, the sleeping bag 1 being in preparation of the first configuration of use, meaning the configuration with a mattress.

The sleeping bag 1 usually comprises one or several flexible panels, such as fabric flexible panels offering a sleeping space.

When dealing with a single flexible panel, this flexible panel is turned down on itself so as to constitute a kind of envelope that can be closed by usual closure means.

When dealing with several flexible panels, it can be an upper panel and a lower panel that are put together for instance by sewing. Possibly, lateral panels can be interposed between the upper and lower panels.

In FIG. 1, as in the following figures, the sleeping bag 1 is represented underneath. Consequently, in these figures, the usual opening through which the user can access the sleeping space cannot be seen.

A reception pocket 3 is arranged on the external face 4 of the single panel or of one of the panels that constitute(s) the sleeping space.

The external face 4 means the face of the panel opposed to the sleeping space.

The reception pocket 3 itself is formed by one or several panels, such as fabric flexible panels, that are put together, for instance by sewing, with the external face 4 of one of the panels constituting the sleeping space.

The reception pocket 3 can thus be formed by one or several panels distinct from the panel(s) constituting the sleeping space, the panel(s) forming the reception pocket 3 being mounted on the external face 4 of the panel(s) constituting the sleeping space.

This reception pocket 3 can also be formed by one or several extensions of one of the panels constituting the sleeping space, such as the lateral panels of this sleeping space.

In the example represented in the figures, the reception pocket 3 is thus shaped as a flap 3 that is turned down on the external face 4 of the panel(s) constituting the sleeping space.

This reception pocket 3 is thus interdependent with at least one of the panels constituting the sleeping space.

The reception pocket 3 defines a housing that can receive a mattress 2, so that the sleeping bag 1 can be used in the first configuration with mattress.

To do so, the reception pocket 3 is provided with an introduction opening 5 for the introduction of the mattress 2.

When the mattress 2 is not introduced in the reception pocket 3 through the introduction opening 5, as represented in FIG. 1, the external face 4 of one of the panels constituting the sleeping space can be seen through the introduction opening 5.

Figure 3:
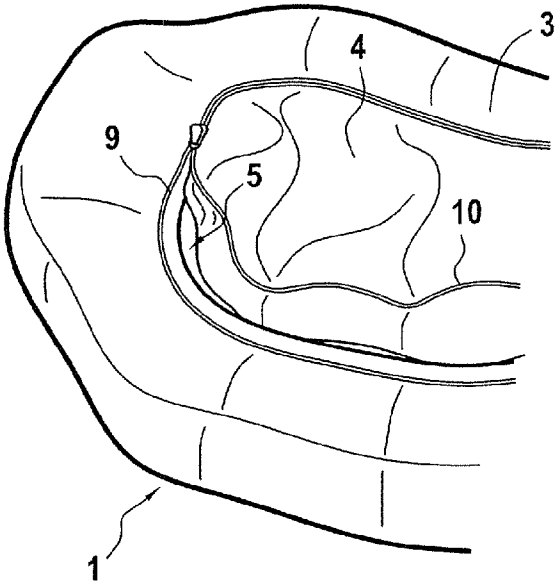
FIG. 3 is a view of a detail of the sleeping bag represented in FIG. 1, in preparation of the second configuration without the mattress.

The reception pocket 3 is also provided with securing means 6, 7, that will be described in a more complete manner in reference in particular to FIGS. 3 and 4.

Securing means 6, 7 enable the mattress 2 to stay adequately in the reception pocket 3 in the first configuration.

First and second attachment means 9, 10 are also represented in FIG. 1 and will be described in a more complete manner in reference in particular to FIGS. 3 and 4.

First attachment means 9 are distributed around the introduction opening 5, and second attachment means 10 are arranged on the external face 4 of one of the panels constituting the sleeping space.

First and second attachments means 9, 10 are configured to be able to cooperate together in the second configuration without mattress, so that the introduction opening 5 can be closed.

Figure 2:
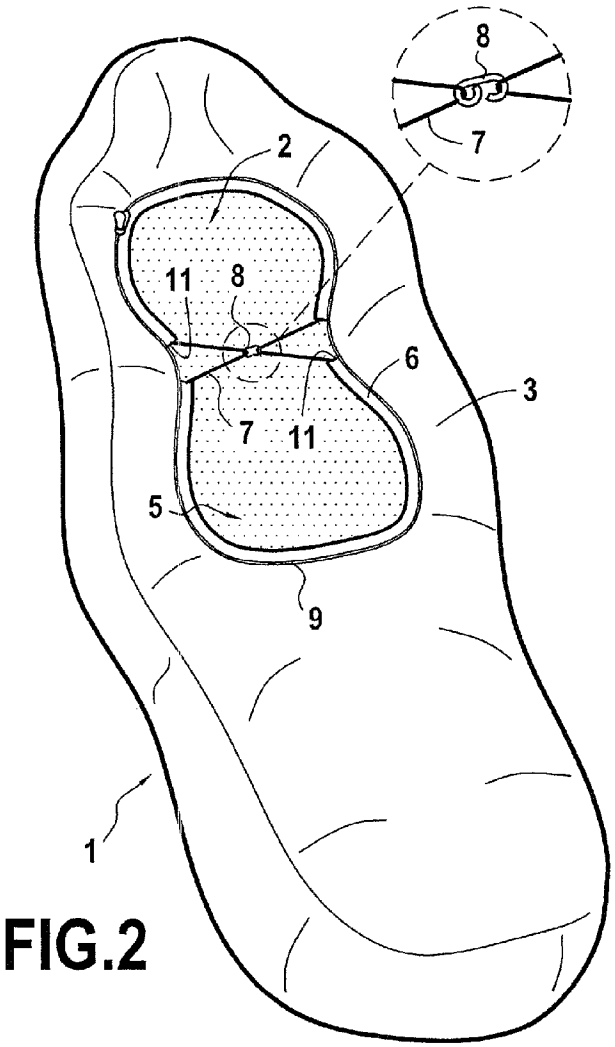
FIG. 2 is a view of the sleeping bag represented in FIG. 1, in the first configuration with the mattress.

Once the mattress 2 has been introduced in the reception pocket 3 through the introduction opening 5, the sleeping bag 1 is in its first configuration, as represented in FIG. 2.

Precisely, in this first configuration with the mattress 2, securing means 6, 7 are implemented in order to support the mattress 2 adequately in place in the reception pocket 3.

In the example represented in these figures, securing means 6, 7 are shaped as a flexible rangy element 7 introduced in a guide 6 that is disposed around the introduction opening 5. This guide 6 can be a continuous or intermittent fabric sheath, and enables the flexible rangy element 7 to be slid.

When the flexible rangy element 7 is grasped through an opening formed in the guide 6, the flexible rangy element 7 can be pulled, involving a strengthening of the introduction opening 5, and therefore, an adequate support of the mattress 2 in the reception pocket 3.

Securing means 6, 7 can also include a blocking element 8 that can temporarily prevent or limit the sliding, and thus the strengthening, of the flexible rangy element 7 in the guide 6, and thus prevent or limit the widening of the introduction opening 5.

In the example represented in the figures, the flexible rangy element 7 slides in a sheath 6, and can be pulled out of this sheath 6 at the level of two diametrically opposed openings 11 formed in the sheath 6.

To maintain the flexible rangy element 7 in this position, the blocking element 8 is shaped as a hook 8 that can temporarily bring together both portions of the flexible rangy element 7 pulled out of the sheath 6.

This flexible rangy element 7 is preferably elastic, in order to get the adequate support of the mattress 2 in the reception pocket 3, but with a certain flexibility due to the elasticity of the flexible rangy element 7. This flexibility enables a slight variation of the strengthening of the introduction opening 5 that increases the user's comfort in the first configuration, in particular when the user moves in the sleeping space.

Securing means are however not limited to the combination of a flexible rangy element 7, preferably elastic, sliding in a guide or a sheath 6, possibly completed with the blocking element 8.

We can indeed for instance be satisfied with an element made of an elastic material disposed completely or partially around the introduction opening 5. It can relate, for instance, to an elastic fabric disposed on the whole perimeter, or on a portion, of the introduction opening 5.

When it is not stretched, this elastic element must be such as to retract so that the dimensions of the introduction opening 5 decrease till it prevents, or at least bothers, the introduction and the withdrawal of the mattress 2.

Figure 4:
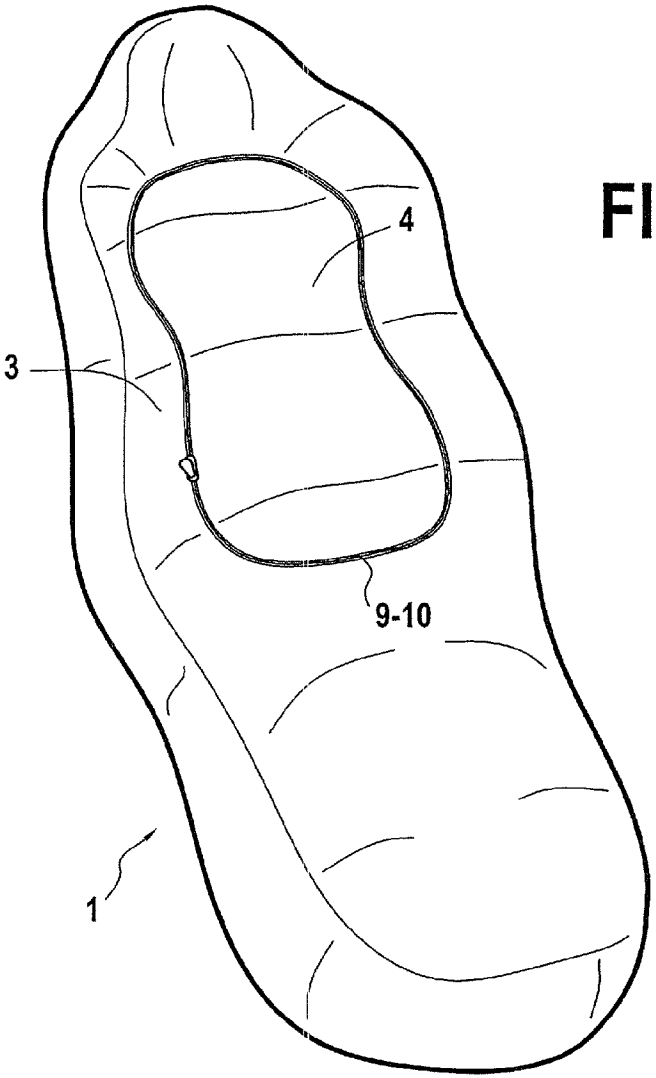
FIG. 4 is a view of the sleeping bag represented in FIG. 1, in the second configuration without the mattress.

When the mattress 2 is withdrawn out of the reception pocket 3 of the sleeping bag 1, first and second attachment means 9, 10 that have been presented above can be implemented, in order to put the sleeping bag 1 in the second configuration without mattress represented in FIG. 4. The implementation of first and second attachment means 9, 10 is represented in details in FIG. 3.

Thus, when the mattress 2 is withdrawn out of the reception pocket 3, and when the user wants to use the sleeping bag 1 in the second configuration, he uses first and second attachment means 9, 10 and make them cooperate together to close the introduction opening 5.

First and second attachment means 9, 10 can also enable to store securing means 6, 7, 8 in the reception pocket 3, when securing means 6, 7, 8 are adequately disposed.

Indeed, when securing means 6, 7, 8 are distributed around the introduction opening 5, when first attachment means 9 are also distributed around the introduction opening 5, but are set back from the introduction opening 5 with regard to securing means 6, 7, 8, and finally when second attachment means 10 are arranged on the external face 4 of the panel(s) constituting the sleeping space, the cooperation between first and second attachment means 9, 10 to close the introduction opening 5 can enable to store securing means 6, 7, 8 by placing them under the flap 3 constituting the reception pocket 3.

First and second attachment means 9, 10 can be for instance a zipper. They can also be hook and loop fasteners, or other usual closure means.

Preferably, the panel(s) constituting the reception pocket 3 comprise(s) extra furnished material. It can be furnished for instance with cotton wool and/or feathers.

This extra furnished material provides an adequate comfort, in particular when the sleeping bag is used in the second configuration, since the user is thus not disturbed by securing means 6, 7, 8 stored in the reception pocket 3.

This extra furnished material is also stored in the closed reception pocket 3, when the sleeping bag is in the second configuration.

Moreover, the extra material of the panel(s) forming the reception pocket 3 can be elastic, in order to improve the freedom of movement, and so the comfort, of the user when the sleeping bag 1 is used in the first configuration.

Indeed, when the user moves in the sleeping space, he pulls on the sleeping bag 1 that is not blocked by the mattress 2.

It can also be planned that the external face 4 of the panel(s) constituting the sleeping space be elastic, in order to improve the freedom of movement, and so the comfort, of the user when the sleeping bag is used in the second configuration.

As represented in FIG. 4, once the introduction opening 5 has been fully closed by the cooperation of first and second attachment means 9, 10, after the withdrawal of the mattress 2, the reception pocket 3 is fully closed. Instead of the reception pocket, only the external face 4 of the panel(s) constituting the sleeping space can be seen.

It is reminded that the present description is given as an illustration, the embodiments that have been presented above being non-limiting examples of the invention.

What is claimed is:

1. A sleeping bag, having a top surface and a bottom surface, able to be used in a first configuration with a mattress and in a second configuration without mattress, said sleeping bag comprising on the one hand a flexible panel or flexible panels that are put together, said flexible panel(s) being able to constitute a sleeping space for a user and having an external face opposed to said sleeping space, and on the other hand a reception pocket arranged on said external face and defining a housing for receiving said mattress in said first configuration, said housing being separate from the sleeping space, wherein said reception pocket is integral with said flexible panel or with one of said flexible panels that are put together, said reception pocket presenting an introduction opening on said bottom surface for said mattress and being provided with securing means able to secure said mattress in said reception pocket in said first configuration, wherein said reception pocket is provided with first attachment means distributed around said introduction opening, said external face of said flexible panel being provided with second attachment means, and wherein said first and second attachment means are able to cooperate together in said second configuration so that said introduction opening can be closed.

2. The sleeping bag according to claim 1, wherein said securing means are arranged so that they can be stored in said reception pocket in said second configuration.

3. The sleeping bag according to claim 1, wherein said securing means include at least a flexible rangy element inserted in a guide being continuous or intermittent and disposed around said introduction opening, said flexible rangy element being able to slide in said guide.

4. The sleeping bag according to claim 3, wherein said guide presents at least an opening through which said flexible rangy element can be reached.

5. The sleeping bag according to claim 4, wherein said guide presents at least two openings through which said flexible rangy element can be reached.

6. The sleeping bag according to claim 5, wherein said blocking element is able to bring together a portion of said flexible rangy element reached by one of said two openings formed in said guide with a portion of said flexible rangy element reached by the other of said two openings formed in said guide.

7. The sleeping bag according to claim 5, wherein said at least two openings are diametrically opposed.

8. The sleeping bag according to claim 4, wherein said securing means include a blocking element that can limit the sliding of said flexible rangy element in said guide.

9. The sleeping bag according to claim 3, wherein the flexible rangy element is elastic and wherein the guide is a sheath.

10. The sleeping bag according to claim 1, wherein said securing means include at least an elastic element disposed continuously or intermittently around said introduction opening.

11. The sleeping bag according to claim 1, wherein said external face of said flexible panel(s) constituting said sleeping space is made of elastic material.

12. A sleeping kit, that includes a sleeping bag according to claim 1 and a mattress able to be disposed in said reception pocket.

* * * * *